US007913708B2

(12) United States Patent
Yung

(10) Patent No.: US 7,913,708 B2
(45) Date of Patent: Mar. 29, 2011

(54) ONE-HANDED OPERATING MECHANISM FOR OPENING AND CLOSING UMBRELLA

(76) Inventor: Kwong Yuen Yung, East Brunswick, NJ (US)

( * ) Notice: Subject to any disclaimer, the term of this patent is extended or adjusted under 35 U.S.C. 154(b) by 278 days.

(21) Appl. No.: 11/664,452

(22) PCT Filed: Sep. 8, 2005

(86) PCT No.: PCT/CN2005/001431

§ 371 (c)(1),
(2), (4) Date: Apr. 2, 2007

(87) PCT Pub. No.: WO2006/042451

PCT Pub. Date: Apr. 27, 2006

(65) Prior Publication Data

US 2007/0289619 A1 Dec. 20, 2007

(30) Foreign Application Priority Data

Oct. 20, 2004 (CN) ..... 2004 2 0104953 U

(51) Int. Cl.
*A45B 25/14* (2006.01)

(52) U.S. Cl. ..... 135/22; 135/20.3; 135/24

(58) Field of Classification Search ..... 135/20.3, 135/22, 24, 25.4, 15.1; 222/470–478; 248/231.9, 248/231.91; 223/116–119
See application file for complete search history.

(56) References Cited

U.S. PATENT DOCUMENTS 337,276 A * 3/1886 Meyer, Jr. ..... 135/22
1,091,895 A * 3/1914 Schaaf ..... 135/23
2,454,059 A * 11/1948 Heaney ..... 135/24
3,752,199 A * 8/1973 Fekete ..... 140/123.6
3,796,226 A 3/1974 Yuen
4,149,553 A * 4/1979 Lee ..... 135/24
4,225,174 A * 9/1980 Hennessy et al. ..... 294/1.4
(Continued)

FOREIGN PATENT DOCUMENTS

CN 2346257 Y 11/1999
(Continued)

OTHER PUBLICATIONS

International Search Report from corresponding PCT Application No. PCT/CN2005/001431.

*Primary Examiner* — Winnie Yip
(74) *Attorney, Agent, or Firm* — Kriegsman & Kriegsman

(57) ABSTRACT

A one-handed operating mechanism for opening and closing umbrella comprises a handle (1) connected to the bottom end of the stem of the umbrella, an elbow member (2) at its curve pivotally connected to said handle (1), a connecting member (3) with its upper end connected to a slide sliding along the stem to open or close the umbrella, said handle (1) is provided with a channel (4) extending from the upper end to the lower end of the handle to accommodate said elbow member (2) and said connecting member (3) to be moving therein, said channel (4) possesses a bottom side (13), said elbow member (2) possesses a handgrip section (5) exposed outside said channel (4) for palm squeezing, and an actuating section (6) located inside said channel (4) for mutual driving with said connecting member. The connecting member is driven by way of operating the elbow member, thereby driving the slide to slide along the stem to push the runner upward toward the crown to open the umbrella.

6 Claims, 5 Drawing Sheets

U.S. PATENT DOCUMENTS

| | | | | | |
|---|---|---|---|---|---|
| 4,685,482 | A | | 8/1987 | Yung | |
| 4,802,499 | A | * | 2/1989 | Lisack | 135/24 |
| 4,989,625 | A | * | 2/1991 | Wu | 135/22 |
| 5,088,512 | A | | 2/1992 | Chou et al. | |
| 5,816,276 | A | * | 10/1998 | Seidel et al. | 135/24 |
| 5,913,321 | A | | 6/1999 | Yung | |
| 6,805,716 | B2 | * | 10/2004 | Ralph et al. | 623/17.16 |

FOREIGN PATENT DOCUMENTS

| | | | | |
|---|---|---|---|---|
| CN | 1473527 | A | | 2/2004 |
| GB | 2250191 | A | * | 6/1992 |
| JP | 06054707 | A | * | 3/1994 |
| JP | 8000325 | A | | 1/1996 |
| JP | 08299041 | A | * | 11/1996 |
| WO | WO 96/35347 | A1 | | 11/1996 |

* cited by examiner

ONE-HANDED OPERATING MECHANISM FOR OPENING AND CLOSING UMBRELLA

FIELD OF THE INVENTION

The present invention relates to a one-handed control operating mechanism for opening and closing umbrella, particularly to an operating mechanism connected to the bottom end of the stem of the umbrella to be operated by one hand to open and close an umbrella.

BACKGROUND OF THE INVENTION

A one-handed operating mechanism for use in an umbrella has been described in the applicant owned U.S. Pat. No. 3,796,226, Chinese Patent No. 86101477.4 (corresponding U.S. Pat. No. 4,685,482), Chinese. Patent No. ZL95211861.0 (corresponding PCT Application No. PCT/CN96/00029), and U.S. Pat. No. 5,913,321. The construction of such an operating mechanism is suitable for use in those umbrellas possessing a slide which is slidable along the stem to move the runner toward the crown. The opening motion can be achieved by pushing or pulling by finger or fingers, or by squeezing of the palm to make the slide travel the required distance. The above said patents are incorporated herein by reference.

SUMMARY OF THE INVENTION

The object of the present invention is to provide a one-handed operating mechanism with simple construction and convenient operation for use in umbrella.

Another object of the present invention is to provide a one-handed operating mechanism for use in umbrella, which possesses a higher mechanical advantage to provide a stronger force required to flex the ribs and to tension the cover at the last stage of the opening movement.

The one-handed operating mechanism according to the present invention comprises a handle connected to the bottom end of the stem of the umbrella, an elbow member at its curve pivotally connected to said handle, a connecting member with its upper end connected to a slide sliding along the stem to open or close the umbrella; said handle is provided with a channel, said channel extends from the upper end to the lower end of the handle to accommodate said elbow member and said connecting member to be moving therein; said channel possesses a bottom side; said elbow member possesses a handgrip section exposed outside the channel to facilitate palm squeezing, and an actuating section located inside the channel to be driven by each other with the connecting member.

In the above said one-handed operating mechanism, the end portion of said actuating section of said elbow member is adherent to the lower end of said connecting member.

In the above said one-handed operating mechanism, a link is further provided, the end portion of said actuating section of said elbow member is pivotally connected to one end of said link, and the other end of said link is pivotally connected to the lower end of said connecting member.

In the above said one-handed operating mechanism, the distance between the end portion of said actuating section of the elbow member and said bottom side of said channel is longer when said actuating section is located at its end position after travel, as compared to the similar distance when the actuating section is located at the starting position before moving.

In the above said one-handed operating mechanism, the distance between the point of the pivot connecting the end portion of said actuating section of the elbow member with said link and said bottom side of said channel is longer when said actuating section is located at the starting position before moving, as compared to the similar distance when said actuating section is located at the position where it has travelled the first half of its movement.

In the above said one-handed operating mechanism, the lower end of said connecting member is provided with a sidewise extension, a clutch is provided to be pivotally connected to the upper half of the handle, a compression spring is provided between the lateral surfaces of said handle and the upper end of said clutch to bias said clutch, the lower end of said clutch and said extension of said connecting member will automatically lock each other when the umbrella has attained its fully open state, the upper end of said clutch is provided for the finger to press thereon to drive the lower end of said clutch to release said extension of said connecting member.

In the above said one-handed operating mechanism, said connecting member is a straight rod, and the end portion of said actuating section of the elbow member is pivotally connected to the lower end of said straight rod.

In the above said one-handed operating mechanism, a protrusion is provided on said bottom side of said channel near the lower end thereof to prevent the further downward movement and to define the starting position of said actuating section of the elbow member.

Adopting the above said operating mechanism the umbrella can be easily opened or closed through the achievement of operating said operating mechanism by one hand. To squeeze said handgrip section of the elbow member with the palm of the hand holding the handle will open the umbrella. To close the umbrella, the hand holding the handle should be shifted upward to hold the upper half of the handle and to press the upper end of the clutch provided on the handle, with the tip of the umbrella lifting upward, the umbrella will be closed by its own weight under the influence of gravity. Or, the force storage achieved in the opening process of the umbrella, for example, the spring force of the compression spring achieved in the compression in the opening process, can be utilized to close the umbrella.

The preferred embodiments of the present invention will be illustrated by way of example in the accompanying drawings.

DETAILED DESCRIPTION OF THE INVENTION

Figure 1:
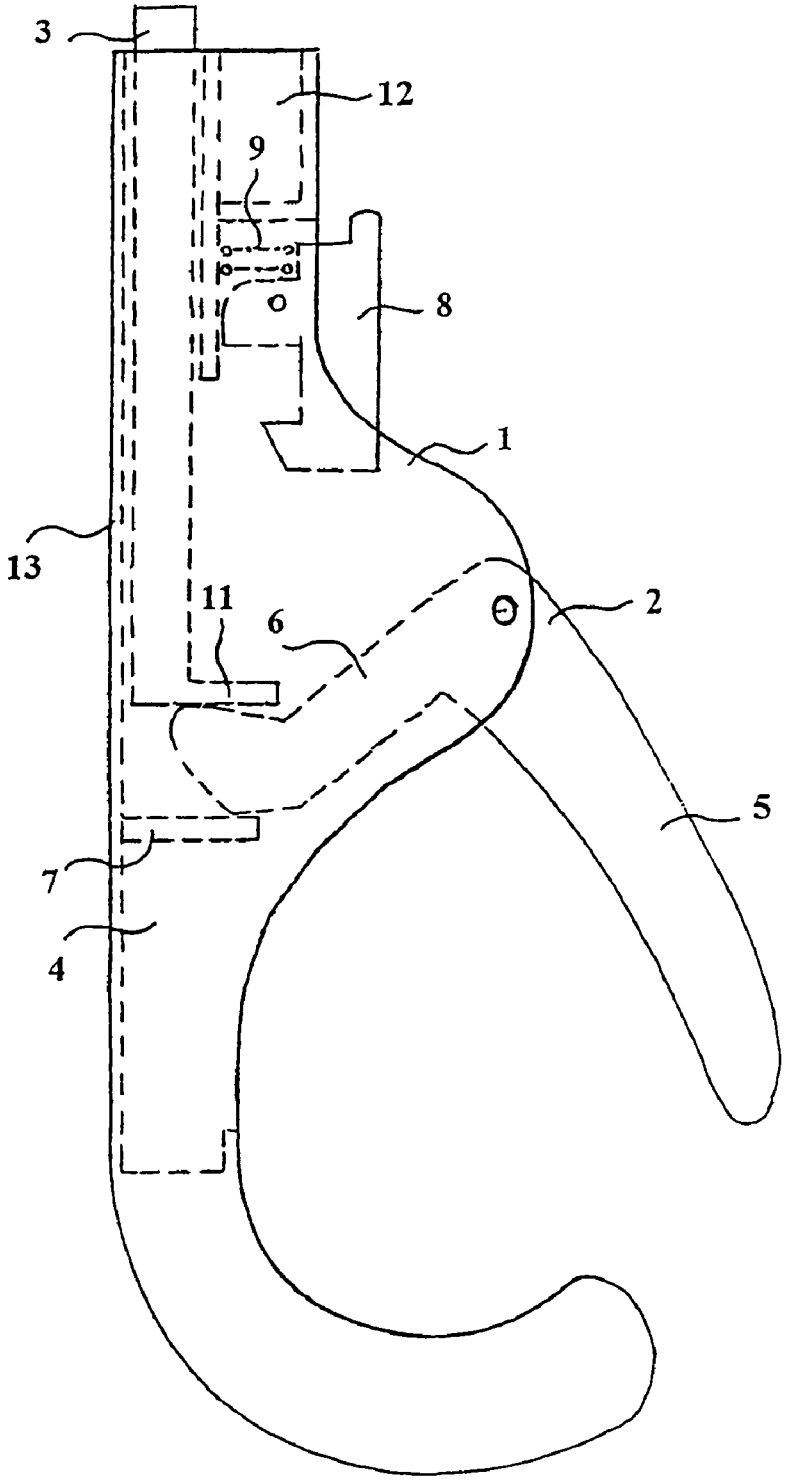
FIG. 1 shows the specific construction of the one-handed operating mechanism for use in umbrella of one embodiment of the present invention in the position before actuation.
Figure 2:
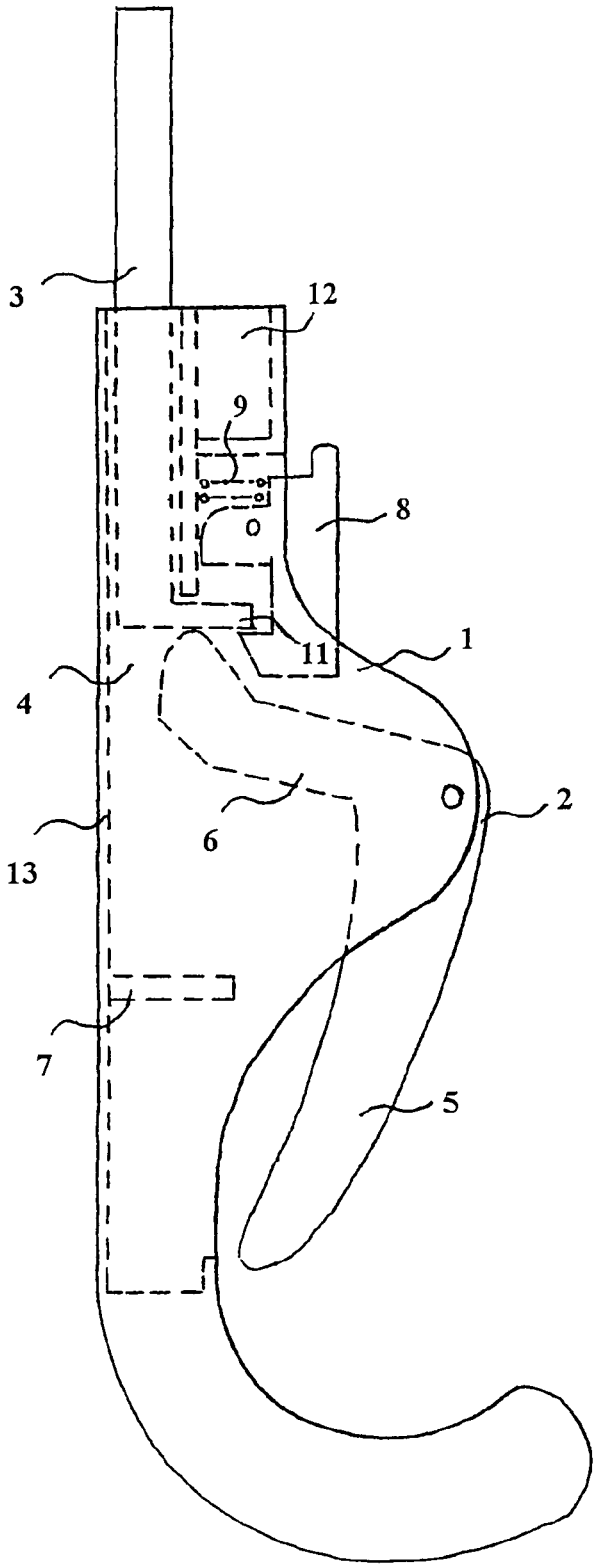
FIG. 2 shows the one-handed operating mechanism shown in FIG. 1 in the actuated position, in which the connecting member has been moved to open the umbrella in the fully open state.

Referring to FIG. 1 to FIG. 2, the one-handed operating mechanism according to one embodiment of the present invention comprises a handle 1 connected to the bottom end of the stem (not shown) of the umbrella, an elbow member 2 at its curve pivotally connected to the handle 1, a connecting member 3 with its lower end provided with a sidewise extension 11 and its upper end connected or pivotally connected or attached to the slide (not shown) sliding along the stem to open or close the umbrella. The handle 1 is provided with a channel 4 which extends from the handle's upper end to lower end to accommodate the elbow member 2 and the connecting member 3 to be moving inside the channel. The upper end of the handle 1 is provided with a cavity 12 to accommodate the bottom end of the stem and to connect therewith. The handgrip section 5 of the elbow member 2 is exposed outside the channel 4 to facilitate palm squeezing, while the actuating section 6 is located inside the channel with its end portion adherent to the lower end of the connecting member 3 to drive each other. A protrusion 7 is provided on the bottom side 13 of the channel 4 near its lower end to prevent the further downward movement and to define the starting position of the actuating section 6. A clutch 8 is pivotally connected to the upper half of the handle 1, and a compression spring 9 is provided between the lateral surfaces of the handle 1 and the upper end of the clutch 8, biasing the clutch clockwise. When the actuating section 6 moves its way to its end position, the lower end of the clutch 8 and the extension 11 of the connecting member 3 will lock each other. The upper end of the clutch is provided for the finger to press thereon to drive the lower end of the clutch 8 to release the extension 11 of the connecting member 3. To open the umbrella, the hand holding the handle 1 needs only to squeeze the handgrip section 5 of the elbow member 2 with the palm to let the actuating section 6 drive the connecting member 3 upward, and the extension 11 and the clutch 8 will automatically lock each other to maintain the umbrella in the fully open state when the actuating section 6 has reached its end position. To close the umbrella, the hand holding the handle 1 should be shifted upward to hold the upper half of the handle 1 and to press the upper end of the clutch 8 with the finger, and meanwhile hold the umbrella with its tip upward, the umbrella will be closed by its own weight under the influence of gravity. Or, the force storage achieved in the opening process of the umbrella, for example, the spring force of the compression spring (not shown) achieved in the compression in the opening process, can be utilized to close the umbrella.

In the abovementioned embodiment of the present invention the end portion of said actuating section 6 and the lower end of said connecting member 3 are adherent to each other. It is designed that the distance between said point of adherence and the bottom side 13 of said channel 4 is longer when said actuating section 6 has travelled to its end position, as compared to the similar distance when the actuating section stays at the starting position before moving. Therefore, said connecting member 3 will be moved over one half of the entire movement required to open the umbrella after said actuating section 6 has travelled the first half of its movement; when said actuating section 6 travels the second half of its movement, said connecting member 3 needs only to travel less than one half of its entire opening movement, thereby acquiring a higher mechanical advantage to provide a stronger force required to flex the ribs and to tension the cover. The diversity between the above said distances at different positions may be different with different designs; nevertheless, said actuating section 6 and said connecting member 3 will still drive each other to achieve a coordinated operation without any obstruction.

Figure 3:
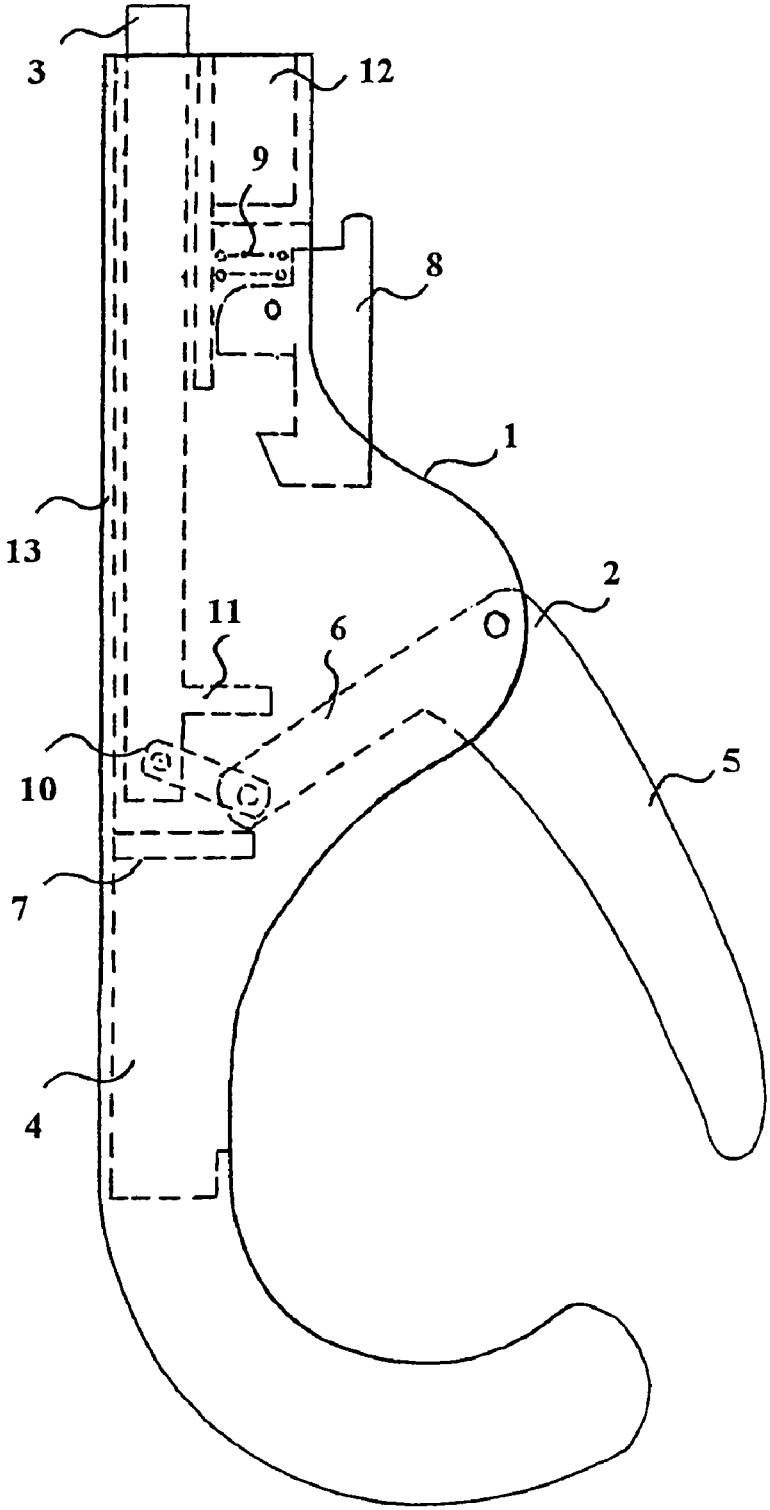
FIG. 3 shows the specific construction of the one-handed operating mechanism of another embodiment of the present invention in the starting position, in which a link is shown to be pivotally connected between the actuating section and the connecting member.
Figure 4:
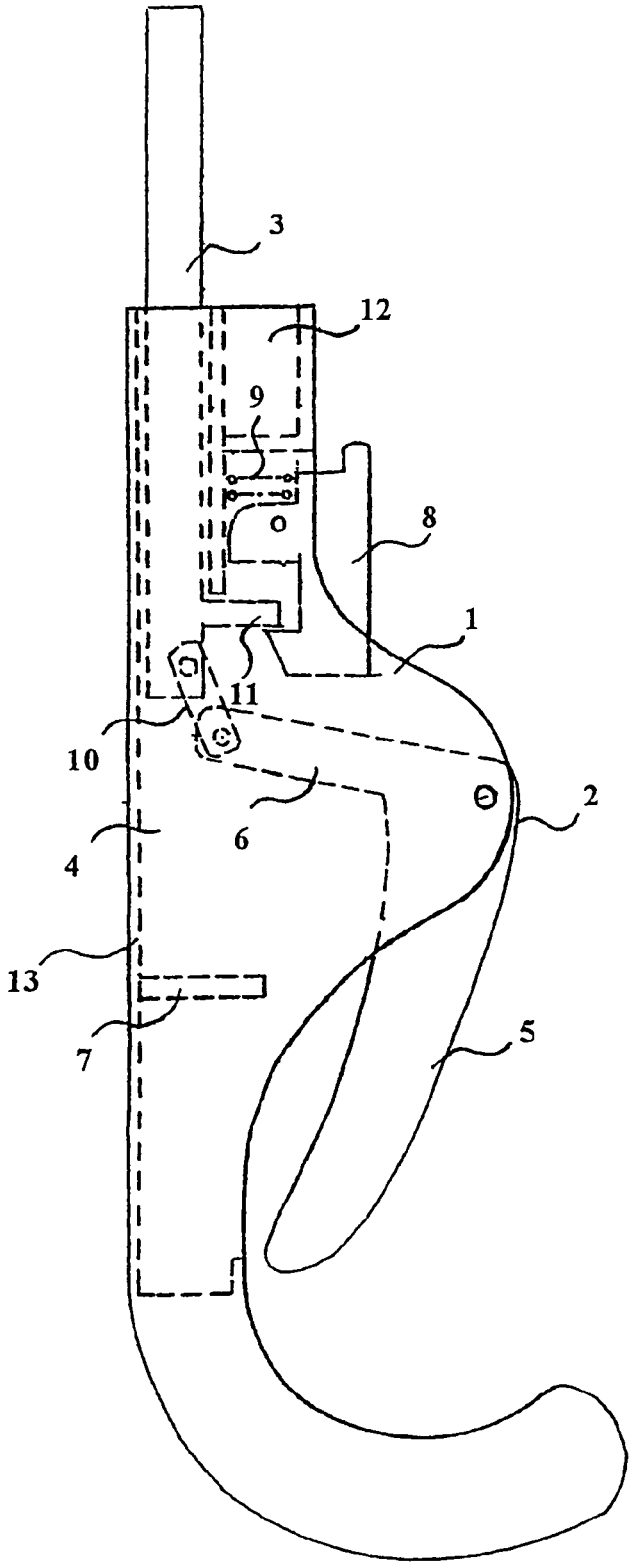
FIG. 4 shows the one-handed operating mechanism shown in FIG. 3 in the end position, in which a link is pivotally connected between the actuating section and the connecting member.

Another embodiment of the present invention is shown in FIG. 3 and FIG. 4, in which the end portion of the actuating section 6 is pivotally connected to one end of a link 10, while the other end of the link 10 is pivotally connected to the lower end of the connecting member 3. Said one-handed operating mechanism is operated in the same way as the abovementioned embodiment.

In the abovementioned another embodiment of the present invention, it is designed that the distance between the point of the pivot connecting the end portion of said actuating section 6 of the elbow member 2 with said link 10 and the bottom side 13 of said channel 4 is longer when said actuating section 6 stays at the starting position before moving, as compared to the similar distance when the actuating section has travelled the first half of its movement. Therefore, said connecting member 3 will be moved over one half of the entire movement required to open the umbrella after said actuating section 6 has travelled the first half of its movement; when said actuating section 6 travels the second half of its movement, said connecting member 3 needs only to travel less than one half of its entire opening movement, thereby acquiring a higher mechanical advantage to provide a stronger force required to flex the ribs and to tension the cover. The diversity between the above said distances at different positions may be different with different designs; nevertheless, said actuating section 6 and said connecting member 3 will still drive each other to achieve a coordinated operation without any obstruction.

Figure 5:
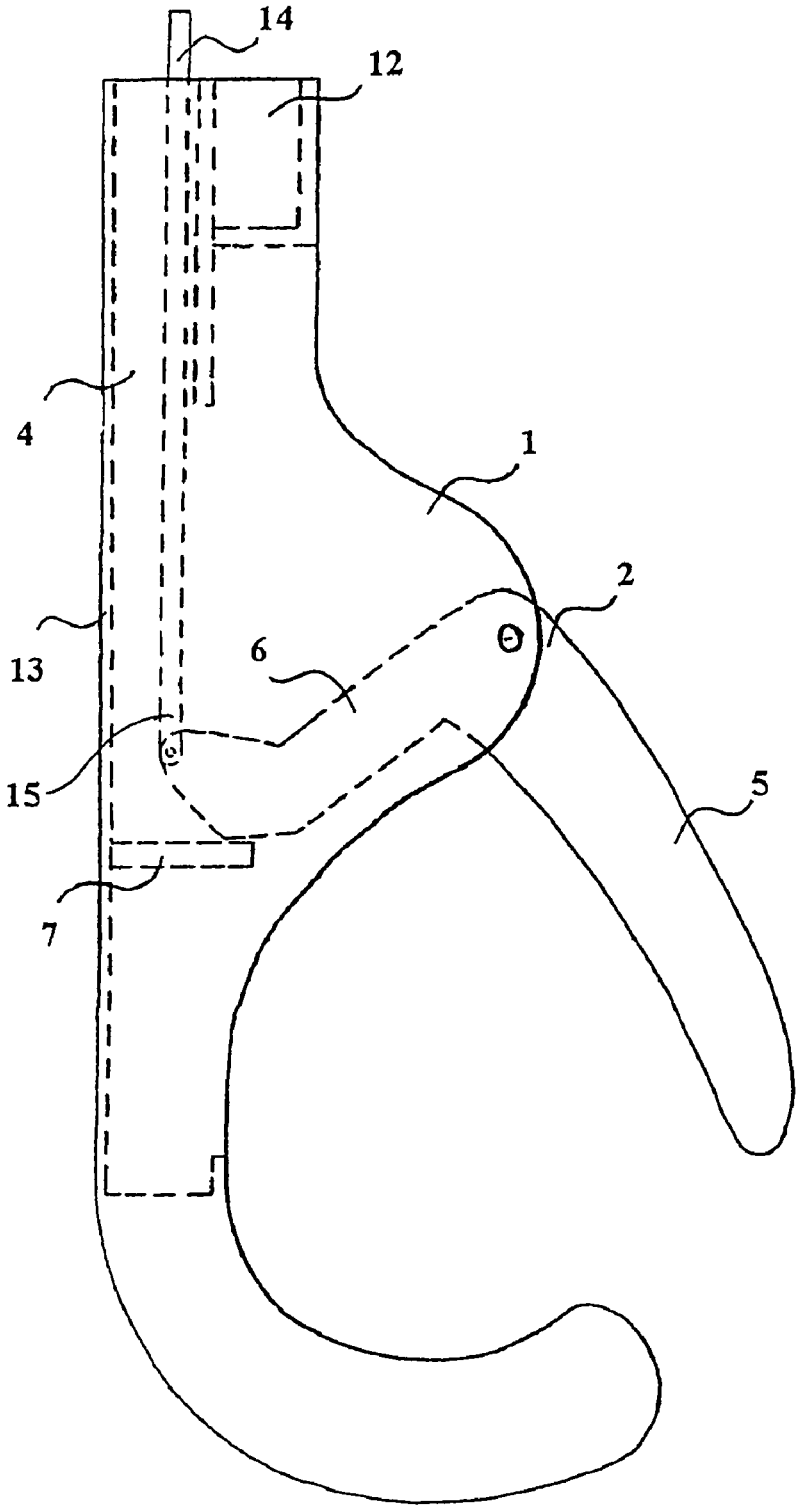
FIG. 5 shows the specific construction of the one-handed operating mechanism of the still another embodiment of the present invention, in which the end portion of the actuating section of the elbow member is pivotally connected to the lower end of the connecting member.

Referring to FIG. 5, in the still another embodiment of the present invention, the clutch 8 provided in the upper part of the handle 1 is obviated, and the connecting member is a straight rod 14, with its lower end 15 pivotally connected to the end portion of the actuating section 6. To open the umbrella, the hand holding the handle 1 needs only to squeeze the handgrip section 5 of the elbow member 2 with the palm to let the actuating section 6 drive the straight rod 14 to open the umbrella, and the hand should remain tightly grasping the handgrip section 5 to maintain the umbrella in the opening state. To close the umbrella, the grasp of the hand should be loosened and the hand should be shifted to the upper half of the handle 1 and meanwhile hold the umbrella with its tip upward, then the umbrella will be closed by its own weight under the influence of gravity. Or, the force storage achieved in the opening process of the umbrella, for example, the spring force of the compression spring (not shown) achieved in the compression in the opening process, can be utilized to close the umbrella.

INDUSTRIAL APPLICABILITY

The one-handed operating mechanism for use in opening and closing an umbrella possesses the advantages of simple construction, convenient operation, and a higher mechanical advantage to provide a stronger force required to flex the ribs and to tension the cover when the umbrella reaches the last stage of its opening process.

It will be understood that the specification and example are illustrative but not limitative of the present invention and that other embodiments within the spirit and scope of the invention will suggest themselves to those skilled in the art.

The invention claimed is:

1. A one-handed operating mechanism for opening and closing an umbrella, said one-handed operating mechanism comprising: a handle adapted to be connected to a bottom end of a stem of the umbrella, an elbow member having a curved point, said elbow member being pivotally connected to the handle at said curved point, a connecting member having an upper end and a lower end, said upper end being adapted to be connected, pivotally connected or attached to a slide of the umbrella sliding along the stem of the umbrella for opening and closing the umbrella, wherein said handle has a channel, said channel extending from an upper end to a lower end of the handle, whereby said elbow member and said connecting member are moved therein, said channel has a bottom side, said elbow member having a handgrip section exposed outside the channel for palm squeezing and an actuating section located inside the channel for mutual driving with said connecting member, said one-handed operating mechanism adapted to be connected to an umbrella in open position when said lower end of said connecting member is positioned close to said upper end of said handle and said handgrip section is positioned close to said bottom side of said channel.

2. A one-handed operating mechanism as claimed in claim 1, characterized in that an end portion of said actuating section of the elbow member is adherent to said lower end of said connecting member.

3. A one-handed operating mechanism as claimed in claim 1, characterized in that a link is further provided, an end portion of said actuating section of said elbow member is pivotally connected to one end of said link, and the other end of said link is pivotally connected to said lower end of said connecting member.

4. A one-handed operating mechanism as claimed in claim 1, characterized in that said lower end of said connecting member is provided with a sidewise extension, a clutch is provided to be pivotally connected to said handle, a compression spring is provided between said handle and said clutch for biasing said clutch, a lower end of said clutch and said extension of said connecting member will automatically lock each other when the umbrella has been fully opened, an upper end of said clutch is provided for a finger to press thereon to drive the lower end of said clutch to release said extension of said connecting member.

5. A one-handed operating mechanism as claimed in claim 1, characterized in that said connecting member is a straight rod, an end portion of said actuating section is pivotally connected to a lower end of said straight rod.

6. A one-handed operating mechanism as claimed in claim 1, characterized in that a protrusion is provided on said bottom side of said channel near the lower end thereof to prevent the further downward movement and to define the starting position of said actuating section.

* * * * *